US008808852B2

(12) United States Patent
Minor

(10) Patent No.: US 8,808,852 B2
(45) Date of Patent: Aug. 19, 2014

(54) PROCESS FOR CONTROLLING FATIGUE DEBIT OF A COATED ARTICLE

(75) Inventor: Michael Minor, Arlington, TX (US)

(73) Assignee: United Technologies Corporation, Hartford, CT (US)

( * ) Notice: Subject to any disclaimer, the term of this patent is extended or adjusted under 35 U.S.C. 154(b) by 2082 days.

(21) Appl. No.: 11/775,940

(22) Filed: Jul. 11, 2007

(65) Prior Publication Data

US 2010/0151230 A1 Jun. 17, 2010

(51) Int. Cl.

| | |
|---|---|
| ***B32B 27/08*** | (2006.01) |
| ***C23C 28/02*** | (2006.01) |
| ***C23C 4/18*** | (2006.01) |
| ***C23C 10/60*** | (2006.01) |

(52) U.S. Cl.

CPC ..... *C23C 4/18* (2013.01); *C23C 28/022* (2013.01); *C23C 28/021* (2013.01); *C23C 10/60* (2013.01)

USPC ..... 428/335; 428/332

(58) Field of Classification Search

USPC ..... 428/332, 335

See application file for complete search history.

(56) References Cited

U.S. PATENT DOCUMENTS

| | | | | |
|---|---|---|---|---|
| 3,528,861 | A | 9/1970 | Elam et al. | |
| 3,542,530 | A | 11/1970 | Talboom et al. | |
| 3,649,225 | A | 3/1972 | Simmons | |
| 3,676,085 | A | 7/1972 | Evans et al. | |
| 3,754,903 | A | 8/1973 | Goward | |
| 4,078,922 | A | 3/1978 | Magyar | |
| 4,776,765 | A | 10/1988 | Sumner | |
| 5,458,701 | A * | 10/1995 | Kampe et al. | 148/421 |
| 5,492,726 | A | 2/1996 | Rose | |
| 5,688,607 | A | 11/1997 | Rose | |
| 6,036,995 | A * | 3/2000 | Kircher et al. | 427/142 |
| 6,095,755 | A | 8/2000 | Houston | |
| 6,129,991 | A | 10/2000 | Warnes | |
| 6,273,678 | B1 | 8/2001 | Darolia | |
| 6,344,282 | B1 | 2/2002 | Darolia | |
| 6,555,179 | B1 | 4/2003 | Reeves et al. | |
| 6,589,668 | B1 | 7/2003 | Braithwaite | |
| 6,610,420 | B2 * | 8/2003 | Thompson et al. | 428/633 |
| 6,630,250 | B1 | 10/2003 | Darolia | |
| 6,844,086 | B2 | 1/2005 | Grossman | |
| 6,933,062 | B2 | 8/2005 | Nagaraj et al. | |
| 7,060,366 | B2 | 6/2006 | Gupta et al. | |
| 7,163,718 | B2 | 1/2007 | Das et al. | |
| 2004/0115087 | A1 * | 6/2004 | Axenov et al. | 420/532 |
| 2004/0161628 | A1 * | 8/2004 | Gupta et al. | 428/633 |
| 2005/0112398 | A1 * | 5/2005 | Darolia et al. | 428/632 |
| 2006/0115660 | A1 * | 6/2006 | Strangman et al. | 428/469 |
| 2007/0224443 | A1 * | 9/2007 | Torigoe et al. | 428/632 |

OTHER PUBLICATIONS

European Search Report for EP 08252346.5, dated Sep. 29, 2008.

* cited by examiner

*Primary Examiner* — Samir Shah

(74) *Attorney, Agent, or Firm* — Bachman & LaPointe, P.C.

(57) ABSTRACT

A process for controlling fatigue debit when coating an article includes the steps of: cleaning at least one surface of an article including a structural material; depositing a bond coat material upon at least one cleaned surface of the article to form a bond coat layer substantially free of the structural material; depositing an oxidation resistant material in the presence of an activator upon the bond coat layer at a temperature range from about 1,775° F. (968° C.) to about 1,825° F. (996° C.) to form an additive layer substantially free of the structural material; and wherein the bond coat layer and the additive layer together form a thin film, oxidation resistant coating having a thickness of at least about 0.5 mils.

8 Claims, 2 Drawing Sheets

PROCESS FOR CONTROLLING FATIGUE DEBIT OF A COATED ARTICLE

FIELD OF THE INVENTION

The invention relates to coated articles and, more particularly, relates to processes for controlling fatigue debit of a coated article.

BACKGROUND OF THE INVENTION

Oxidation resistant coatings are typically applied to an engine part at varying thicknesses dependent upon the desired amount of protection. The engine part tends to incur a fatigue debit as the oxidation resistant coating increases in thickness beyond 1 mil. Such fatigue debit lessens the useful service life of engine parts that require such oxidation resistant coatings. Generally, engine parts composed of thin walled honeycomb materials, e.g., 2-5 mils thickness, are completely consumed in a typical aluminide coating process. Essentially, the material becomes a sheet of coating rather than a sheet of material having a coating disposed thereupon. The vapor aluminide coating, by its nature, is extremely brittle and breaks easily.

The thickness of the coating is directly related to the diffusion rate of the oxidation resistant coating material within the CVD chamber. Certain factors influence the diffusion rate of the oxidation resistant coating material, which impact not only the resultant coating but the article's structure and integrity as well. For instance, the application time, operating temperature and halide activator activity influence the resultant coating. Current chemical vapor deposition (CVD) processes operate at a temperature range of 1875° F. (1024° C.) to 2120° F. (1160° C.) when applying, for example, vapor aluminide coatings. The application time coincides with the hold time for the substrate, or article, being coated. At the aforementioned temperatures, the application time is approximately 30 minutes to 60 minutes. Under this time frame, the substrate develops both hot and cold zones rather than uniformly developing a hot zone throughout the substrate. For example, a hot zone may be at the optimum CVD deposition temperature throughout a majority of the application time whereas a cold zone may only attain and maintain the optimum CVD deposition temperature for a fraction of the application time. Under these conditions, the diffusion rate of the aluminum varies and subsequently deposits unevenly upon the hot zones and cold zones. The resultant coating exhibits overly thick areas and sparingly thin areas with respect to the desired coating thickness. This unacceptable non-uniform coating also contributes to inducing fatigue debit to the part.

Therefore, there exists a need for a process for applying oxidation resistant coatings to engine parts without inducing a fatigue debit to the part.

SUMMARY OF THE INVENTION

In one aspect of the present disclosure, a process for controlling fatigue debit when coating an article broadly comprises cleaning at least one surface of an article including a structural material; depositing a bond coat material upon at least one cleaned surface of the article to form a bond coat layer substantially free of the structural material; depositing an oxidation resistant material in the presence of an activator upon said bond coat layer at a temperature range from about 1,775° F. (968° C.) to about 1,825° F. (996° C.) to form an additive layer substantially free of the structural material; and wherein the bond coat layer and the additive layer together form a thin film, oxidation resistant coating having a thickness of at least about 0.5 mils.

In another aspect of the present disclosure, a coated article broadly comprises a structural material; and at least one surface having disposed thereupon a thin film, oxidation resistant coating broadly comprising a bond coat layer substantially free of said structural material; and an additive layer substantially free of said structural material, wherein said bond coat layer and said additive layer have a combined thickness of at least about 0.5 mils.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Using the exemplary process described herein, an article 20 composed of a thin-walled structure having a thickness of no more than about 0.7 mils may be coated without consuming the structure. Generally, both the bond coat layer and additive layer of the thin film, oxidation resistant coating described herein are substantially free of the structural material of the article. As used herein, the term "substantially free" means the thin film, oxidation resistant coating does not contain any structural material, or no more than an insignificant amount of structural material, which does not induce a fatigue debit to the article.

Figure 1:
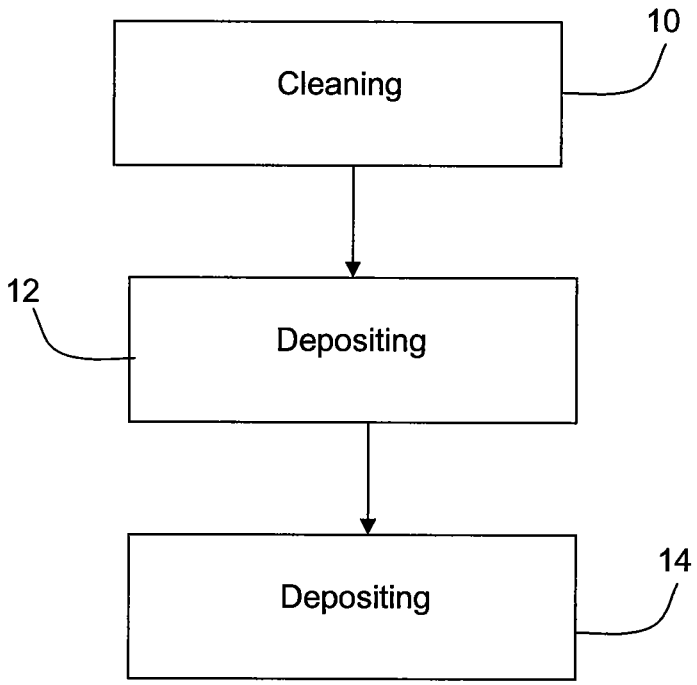
FIG. 1 is a representative flowchart of the process(es) of the present invention.
Figure 2:
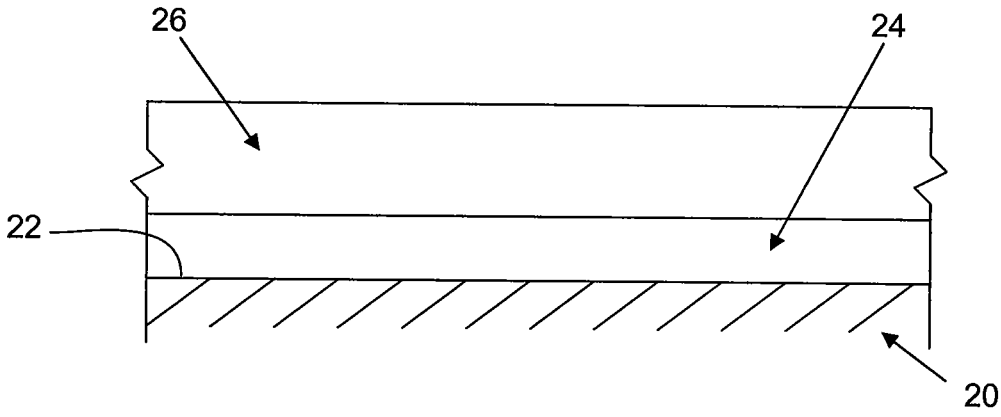
FIG. 2 is a representation of an article coated with an oxidation resistant coating applied in accordance with the exemplary process illustrated in FIG. 1.

FIG. 1 shows a representative flowchart of the exemplary process(es) described herein. Generally, at least one surface 22 of an article 20 being coated may be cleaned to remove any dirt or other particles from contaminating the external surface of the article 20 or the coating layers at step 10. Any one of a number of cleaning techniques known to one of ordinary skill in the art may be employed.

Once cleaned, a quantity of bond coat material sufficient to form a bond coat layer 24 may be applied upon the cleaned external surface of the article at step 12. The bond coat material may comprise a formula MCrAlY. MCrAlY refers to known metal coating systems in which M denotes nickel, cobalt, iron, platinum or mixtures thereof; Cr denotes chromium; Al denotes aluminum; and Y denotes yttrium. MCrAlY materials are often known as overlay coatings because they are applied in a predetermined composition and do not interact significantly with the substrate during the deposition process. In addition, the bond coat material may also comprise Al, PtAl, and the like.

For some non-limiting examples of MCrAlY materials see U.S. Pat. No. 3,528,861 which describes a FeCrAlY coating as does U.S. Pat. No. 3,542,530. In addition, U.S. Pat. No. 3,649,225 describes a composite coating in which a layer of chromium is applied to a substrate prior to the deposition of a MCrAlY coating. U.S. Pat. No. 3,676,085 describes a CoCrAlY overlay coating while U.S. Pat. No. 3,754,903 describes a NiCoCrAlY overlay coating having particularly high ductility. U.S. Pat. No. 4,078,922 describes a cobalt base structural alloy which derives improved oxidation resistance by virtue of the presence of a combination of hafnium and yttrium. A preferred MCrAlY bond coat composition is described in U.S. Pat. No. Re. 32,121, which is assigned to the present Assignee and incorporated herein by reference, as having a weight percent compositional range of 5-40 Cr, 8-35 Al, 0.1-2.0 Y, 0.1-7 Si, 0.1-2.0 Hf, balance selected from the group consisting of Ni, Co and mixtures thereof. See also U.S. Pat. No. 4,585,481, which is also assigned to the present Assignee and incorporated herein by reference.

These bond coat materials may be applied by any method capable of producing a dense, uniform, adherent coating of the desired composition, such as, but not limited to, an overlay bond coat, diffusion bond coat, cathodic arc bond coat, etc. Such techniques may include, but are not limited to, diffusion processes (e.g., inward, outward, etc.), low pressure plasma-spray, air plasma-spray, sputtering, cathodic arc, electron beam physical vapor deposition, high velocity plasma spray techniques (e.g., HVOF, HVAF), combustion processes, wire spray techniques, laser beam cladding, electron beam cladding, etc.

After applying the bond coat layer 24 at step 12, a quantity of oxidation resistant material sufficient to form an oxidation resistant additive layer 26 may be applied upon the bond coat layer 24 or the cleaned external surface of the article at step 14. Preferably, the oxidation resistant material is deposited in the presence of a halide activator. The additive layer 26 may be deposited using any one of a number of vapor deposition techniques, and is preferably deposited using a chemical vapor deposition technique (CVD). One or more articles 20 may be placed in a chamber of a CVD apparatus along with at least one target composed of the oxidation resistant material in the presence of an atmosphere of at least one transport gas and at least one halide activator. Suitable oxidation resistant materials may include various aluminum-containing materials such as aluminum, chromium-aluminum alloys, cobalt-aluminum alloys, iron-aluminum alloys and combinations thereof. The amount of aluminum present may be sufficient to saturate the transport gas atmosphere and the halide activator with aluminum, as is known to one of ordinary skill in the art. Suitable transport gases for use herein may include hydrogen, helium, argon, nitrogen, other inert gases, and combinations thereof.

The operating temperature range, amount of operating time, and choice of halide activator influence the deposition of the oxidation resistant materials upon the article. One of ordinary skill in the art recognizes that the diffusion rate of the oxidation resistant material increases non-linearly with the operating temperature. The goal being to deposit layers of an additive and diffusion barrier materials without consuming the article's thin walled substrate and inducing fatigue debit, or a substantial amount of fatigue debit, to the article's structure.

During the chemical vapor deposition process, the external surface, or optional bond coat layer, may be subjected to the vaporized halide activator via a transport gas for a period of time of about 3 hours to about 20 hours and at a temperature range from about 1,775° F. (968° C.) to about 1,825° F. (996° C.). Suitable halide activators may include $AlF_3$, $AlCl_3$, $AlBr_3$, $AlI_3/NH_4F$, $NH_4Cl$, $NH_4Br$, $NH_4I$, $CrF_3$, $CrCl_3$, $CrBr_3$, and $CrI_3$ and combinations thereof. The powdered halide salt vaporizes entirely during the heating up, and reacts with the substrate material. Suitable halide activators may include any halide salt capable of reacting with the oxidation resistant material and acting as a transport mechanism. For example, representative suitable halides may include ($NH_4F$) HF, $NH_4F$, $AlF_3$, and $NH_4Cl$. The activity of the halide activator is controlled by the type of source material and the amount/type of halide activator. For instance, ammonium based halide activators vaporize entirely which necessitates the control of the amount of halide activator. In contrast, $AlF_3$ emits a controlled vapor pressure based upon the coating temperature during the process, which improves the controllability of the halide activity.

Throughout the deposition process, the gas rate flow of the halide activator and transport gas(es) may be regulated so as to control the deposition of the oxidation resistant materials to slowly deposit and gradually build up the oxidation resistant coating layer to achieve the desired thickness of greater than about 1 mil. The resultant oxidation resistant additive layer 26 may at least comprise aluminum, and may comprise chromium and at least one metal such as nickel, cobalt, iron, platinum, and combinations thereof, provided by the bond coat material. The total thickness range of both the bond coat layer 24 and additive layer 26 may be at least about 0.5 mils, or about 0.5 mils to about 1.5 mils, or about 0.5 mils to about 2 mils. For example, where the total thickness is about 0.5 mils, the bond coat layer may be 0.2 mils thick and the additive layer may be about 0.3 mils thick.

The exemplary processes described herein permit the deposition of an oxidation resistant material upon a thin walled article without consuming the article's thin-walled structure and inducing fatigue debit, or a substantial amount of fatigue debit, to the article's structure.

One or more embodiments of the present invention have been described. Nevertheless, it will be understood that various modifications may be made without departing from the spirit and scope of the invention. Accordingly, other embodiments are within the scope of the following claims.

What is claimed is:

1. A coated article, comprising:

an article formed from a structural material;

said article including at least one surface;

an oxidation resistant coating deposited on said at least one surface, said oxidation resistant coating comprising:

a bond coat layer substantially free of said structural material, said bond coat layer being formed from at least one of a MCrAlY material, an aluminide, and a platinum aluminide; and an additive layer substantially free of said structural material deposited on said bond layer using a chemical vapor deposition technique, said additive layer being formed from an oxidation resistant material selected from the group consisting of chromium-aluminum alloy, cobalt-aluminum alloy, iron-aluminum alloy, titanium-aluminum alloy, and combinations thereof, wherein said bond coat layer and said additive layer have a combined thickness of at least about 0.5 mils.

2. The coated article of claim 1, wherein said bond coat layer is formed from a MCrAlY material comprising aluminum, chromium, yttrium and wherein M is at least one metal selected from the group consisting of nickel, cobalt, iron, platinum and combinations thereof.

3. The coated article of claim 1, wherein said oxidation resistant material is chromium aluminide.

4. The coated article of claim 1, wherein said combined thickness is about 0.5 mils to about 2 mils.

5. The coated article of claim 4, wherein said combined thickness is about 0.5 mils to about 1.5 mils.

6. The coated article of claim 1, wherein said article comprises a turbine engine component.

7. The coated article of claim 1, wherein said additive layer comprises aluminum, chromium, and at least one metal such as nickel, cobalt, iron, platinum, and combinations thereof.

8. The coated article of claim 1, wherein said additive layer comprises the oxidation resistant material selected from the group consisting of cobalt-aluminum alloy, iron-aluminum alloy, titanium-aluminum alloy, and combinations thereof.

* * * * *